US006659300B2

(12) United States Patent
Wurster et al.

(10) Patent No.: US 6,659,300 B2
(45) Date of Patent: Dec. 9, 2003

(54) CONTAINER HAVING SQUARE AND ROUND ATTRIBUTES

(75) Inventors: Michael Wurster, Tecumseh, MI (US); Richard J. Steih, Britton, MI (US); Christopher LaBombarbe, Ypsilanti, MI (US)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/946,971

(22) Filed: Sep. 4, 2001

(65) Prior Publication Data

US 2003/0042222 A1 Mar. 6, 2003

(51) Int. Cl.[7] ..... B65D 51/18
(52) U.S. Cl. ..... 215/379; 215/384; 215/373
(58) Field of Search ..... 215/379–384, 215/373; D9/567, 540, 539, 560

(56) References Cited

U.S. PATENT DOCUMENTS

D31,126 S * 7/1899 Henius ..... D9/546
D93,412 S * 9/1934 Kessler ..... D9/542
D102,283 S * 12/1936 Marrow ..... D9/539
D198,871 S * 8/1964 Akeireb ..... D9/539
D213,824 S * 4/1969 Luedtke ..... D9/560
3,757,983 A * 9/1973 McCarthy ..... 220/33.4
3,804,280 A * 4/1974 van Amerongen et al. . 215/384
4,113,129 A * 9/1978 Cambio, Jr. ..... 215/380
D261,985 S * 11/1981 Fowles et al. ..... D9/390
D272,889 S * 3/1984 Walton ..... D9/520
D275,368 S * 9/1984 Du Chambon ..... D9/520
5,758,790 A * 6/1998 Ewing, Jr. ..... 215/384

* cited by examiner

*Primary Examiner*—Tri M. Mai
(74) *Attorney, Agent, or Firm*—Harness, Dickey & Pierce, P.L.C.

(57) ABSTRACT

A plastic container is provided having an elongated neck, a shoulder region, a body portion and a base. The shoulder region having a substantially square cross section. The base having a substantially circular cross section. The substantially square cross section of the shoulder region preserves the brand identification benefits associated with a square shaped container while the substantially circular cross section of the base preserves the handling and structural attributes associated with a circular shaped container.

10 Claims, 8 Drawing Sheets

CONTAINER HAVING SQUARE AND ROUND ATTRIBUTES

FIELD OF THE INVENTION

This invention generally relates to plastic containers for retaining a commodity, and in particular a liquid commodity. More specifically, this invention relates to a plastic container having a square shoulder region tapered into a round foot print.

BACKGROUND OF THE INVENTION

Numerous commodities previously supplied in glass containers are now being supplied in plastic, more specifically polyester and even more specifically polyethylene terephthalate (PET) containers. The manufacturers and fillers, as well as consumers, have recognized that PET containers are lightweight, inexpensive, recyclable and manufacturable in large quantities.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. Crystallinity is characterized as a volume fraction by the equation:

$$\text{Crystallinity} = \frac{\rho - \rho_a}{\rho_c - \rho_a}$$

where $\rho$ is the density of the PET material; $\rho_a$ is the density of pure amorphous PET material (1.333 g/cc); and $\rho_c$ is the density of pure crystalline material (1.455 g/cc).

The crystallinity of a PET container can be increased by mechanical processing and by thermal processing. Mechanical processing involves orienting the amorphous material to achieve strain hardening. This processing commonly involves stretching a PET preform along a longitudinal axis and expanding the PET preform along a transverse or radial axis to form a PET container. The combination promotes what is known as biaxial orientation of the molecular structure in the container. Thermal processing involves heating the material (either amorphous or semi-crystalline) to promote crystal growth.

The marketing of beverages, particularly liquor, is strongly driven by the need to create and retain brand identification among consumers. One method of increasing brand recognition is the use of a particular container shape. As part of an overall marketing strategy, many beverage marketers have built brand identification based on container shapes having non-circular, particularly square cross sections. In many instances, the investment and benefit in identifying a product by its container configuration precludes changes in container configuration which would enhance manufacturing capabilities but potentially injure brand recognition.

Non-circular shaped containers create several problems during the manufacturing process. For example, square shaped containers must be kept in a particular orientation during filling, labeling and packaging which can significantly decrease production efficiency. Square shaped containers frequently can get caught on machine guides and stack up on the production line. Additionally, square shaped containers require inspection of all four sides in order to locate an appropriate flat surface for labeling. Accordingly, required rotation mechanisms are more complicated. Thus, square shaped containers frequently require re-orientation on the production line, decreasing labeling accuracy, production speed and efficiency.

The outer panels or sides of a square shaped plastic container often sink in and deform due to "shrink back". This phenomenon is magnified under vacuum conditions created by warm fill (i.e., liquid product filled into the container while the liquid product is at an elevated temperature, typically above ambient temperature but below about 54° C. (130° F.)) and cool down. Such sink in and deformation is caused, in part, by a decrease in rigidity found in the outer panels or sides of square shaped plastic containers relative to traditional glass containers. The above described sunken panels cause labeling issues such as rippled labels, poor label adhesion and decreased reliability of automatic processes. One solution to the above described sunken panels has been an attempt to increase panel rigidity by increasing the thickness of the panel through the addition of material. Such an increase in material, however, significantly increases container cost.

Traditional circular shaped plastic containers do not exhibit the sunken panel phenomenon. The curvature of the sidewalls found in a circular shaped plastic container tend to resist buckling better than a flat panel surface. Thus, there is a need for an improved plastic container which maintains brand identity by creating the visual perception of a square shaped container while incorporating the material handling, labeling and structural benefits of a circular shaped container. Compound panel curvature greatly reduces potential panel shrink back.

SUMMARY OF THE INVENTION

It is, therefore, a principal object and purpose of the present invention to provide a plastic container that provides the handling, labeling and structural benefits of a circular shaped container while preserving the brand identification benefits of a square shaped container.

It is an additional principal object and purpose of the present invention to provide a plastic container that does not require frequent re-orientation on the production line, thus increasing labeling accuracy, production speed and efficiency.

It is another object and purpose of the present invention to provide a plastic container that provides increased rigidity and resists panel shrink back.

It is still another object and purpose of the present invention to provide a plastic container having lower resin costs and increased production line efficiencies.

It is another object and purpose of the present invention to provide a plastic container that has a square shoulder region which gradually tapers into a round foot print.

These and other objectives and advantages are provided by the present invention which is directed to a plastic container that provides the handling, labeling and structural benefits of a circular shaped container while preserving the brand identification benefits of a square shaped container. The plastic container includes a neck having a mouth defining an opening into the container, a shoulder region extending from the neck to a body portion, the body portion extending from the shoulder region to a base, the base closing off an end of the container. The neck, shoulder region, body portion and base cooperating to define a receptacle chamber within the container into which product can be filled. The shoulder region has a substantially square cross section while the base has a substantially circular cross section. Consequently, the plastic container creates the visual perception of a square shaped container while incorporating the material handling, labeling and structural benefits of a circular shaped container.

A second embodiment of the invention includes a neck having a mouth defining an opening into the container, a shoulder region having a substantially square cross section, a body portion and a base having a substantially circular cross section. The body portion including pinch grips.

Additional benefits and advantages of the present invention will become apparent to those skilled in the art to which the present invention relates from the subsequent description of the preferred embodiment and the appended claims, taken in conjunction with the accompanying drawings.

BRIEF DESCRIPTION OF THE DRAWINGS

The present invention will become more fully understood from the detailed description and accompanying drawings, wherein.

DETAILED DESCRIPTION OF THE PREFERRED EMBODIMENT

Figure 1:
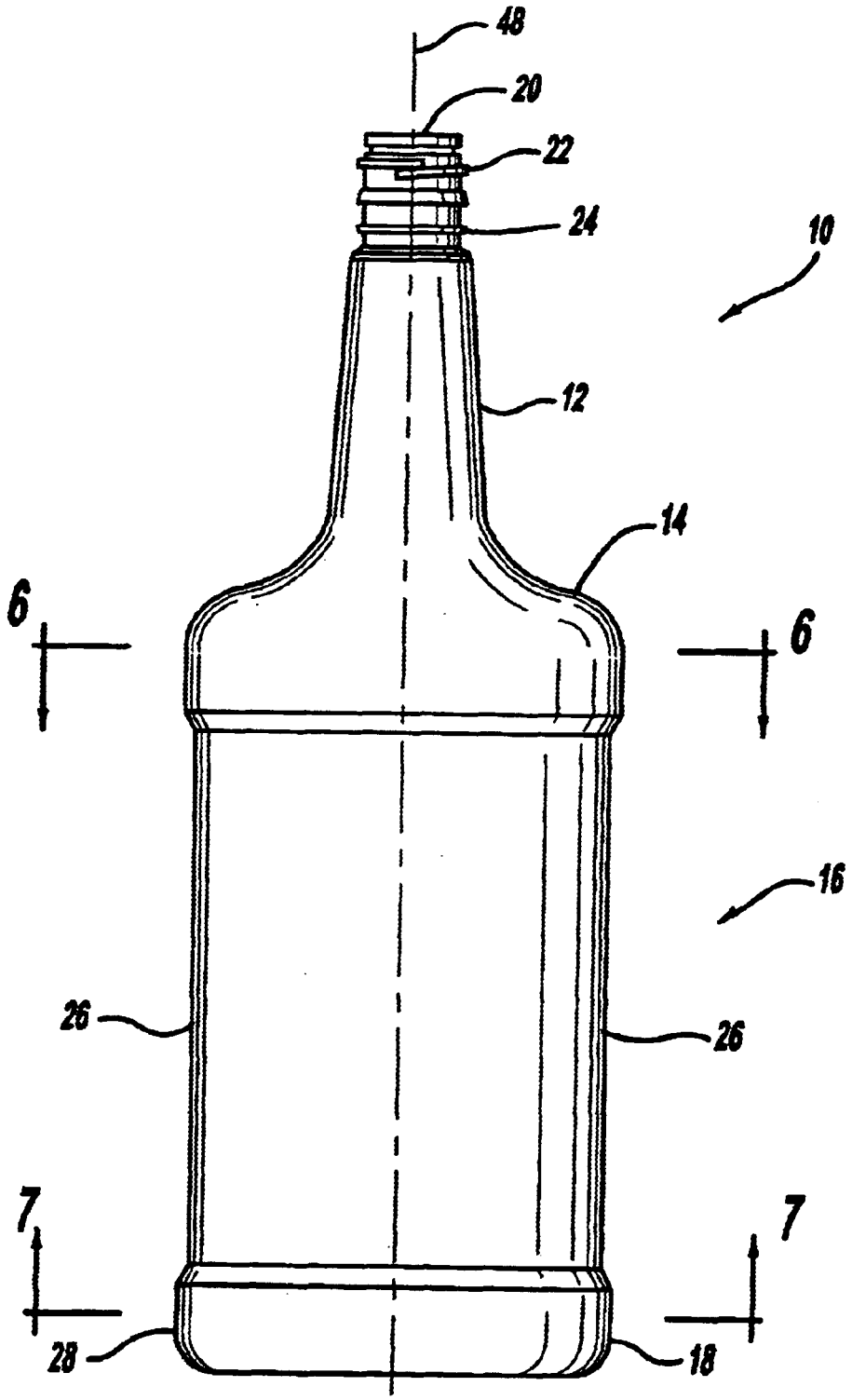
FIG. 1 is a front elevational view of a plastic container in accordance with the present invention.

The following description of the preferred embodiment is merely exemplary in nature, and is in no way intended to limit the invention or its application or uses.

As illustrated in FIGS. 1–5, a plastic container 10 of the present invention includes an elongated neck 12, a shoulder region 14, a body portion 16 and a base 18. The neck 12 of the plastic container 10 includes a portion defining an aperture or mouth 20, a threaded region 22 and a support ring 24. The aperture 20 allows the plastic container 10 to receive a commodity while the threaded region 22 provides a means for attachment of a similarly threaded closure or cap (not shown), which preferably provides a hermetical seal for the plastic container 10. The support ring 24 may be used to carry or orient the preform (the precursor to the plastic container 10) (not shown) through and at various stages of manufacture. For example, the preform may be carried by the support ring 24, the support ring 24 may be used to aid in positioning the preform in the mold, or the support ring 24 may be used by an end consumer to carry the plastic container 10.

Integrally formed with the elongated neck 12 and extending downward therefrom is the shoulder region 14. The shoulder region 14 merges into and provides a transition between the elongated neck 12 and the body portion 16. The body portion 16 extends downward from the shoulder region 14 and includes sidewalls 26. Because of the specific construction of the plastic container 10, the sidewalls 26 may be formed without the inclusion therein of vacuum panels, and if desired, is generally smooth.

The base 18 of the plastic container 10, which generally extends inward from the body portion 16, includes a chime 28 and an intravenous slot or notch 30 formed therein. The base 18 functions to close off the bottom portion of the plastic container 10 and, together with the elongated neck 12, the shoulder region 14 and the body portion 16, to retain the commodity.

The plastic container 10 of the present invention is a blow molded, biaxially oriented container with an unitary construction from a single or multi-layer material such as polyethylene terephthalate (PET) resin. Alternatively, the plastic container 10 may be formed by other methods and from other conventional materials. Plastic containers blow molded with an unitary construction from PET materials are known and used in the art of plastic containers, and their general manufacture in the present invention will be readily understood by a person of ordinary skill in the art.

With continued reference to FIGS. 1–5, the neck 12 of the plastic container 10 is elongated, enabling the plastic container 10 to accommodate volume requirements. Additionally, as a result of the neck 12 of the plastic container 10 being elongated, the need for three (3) separate labels is eliminated. A rear label of the plastic container 10 is not required as the information contained therein can be added to a larger label which easily fits on the elongated neck 12 of the plastic container 10. Thus, the elongated neck 12 of the plastic container 10 eliminates the need for a third label thereby reducing label costs and improving production efficiencies.

Figure 6:
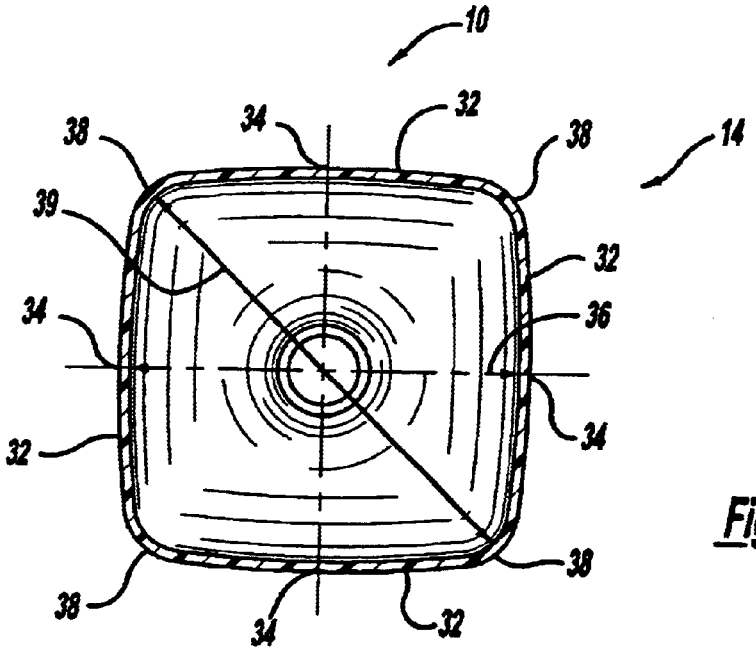
FIG. 6 is a cross sectional view of the plastic container, taken generally along line 6—6 of FIG. 1.

As illustrated in FIG. 6, the shoulder region 14 has a substantially square cross section. Accordingly, the shoulder region 14 of the plastic container 10 includes four sides 32, all of which are substantially equal in length. Each side 32 is slightly bent inward at a midpoint 34 or, stated differently, each side 32 is an arc of relatively large radius. The dimension between the midpoints 34 of opposing sides 32 defines a shoulder width 36. Between each side 32 and integrally formed therewith are rounded corners 38. The rounded corners 38 are arcs of relatively small radius. The dimension between opposite rounded corners 38 defines a diagonal distance 39. The relative proportions of the radii of the sides 32 and the rounded corners 38 may be adjusted accordingly to balance the visual perception of a square, taking into account productability and structural considerations.

Figure 7:
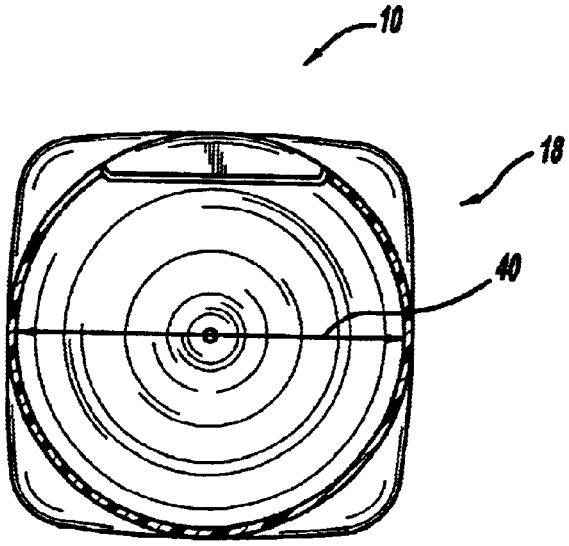
FIG. 7 is a cross sectional view of the plastic container, taken generally along line 7—7 of FIG. 1.

As illustrated in FIG. 7, the base 18 of the plastic container 10 has a substantially circular cross section. The dimension of the diameter of the base 18 defines a base width 40. As described above, and with continued reference to FIGS. 3–5, the base 18 includes the chime 28 and the intravenous slot or notch 30 formed therein. The intravenous slot or notch 30 is located at a rear portion of the base 18 of the plastic container 10 and is generally centered thereon. The intravenous slot or notch 30 is generally polygonal in shape and includes an inclined surface 42, a rear surface 44 and sides 46. The inclined surface 42 slopes downward from the rear portion of the plastic container 10 toward a front portion of the plastic container 10. The rear surface 44 is generally vertical. The intravenous slot or notch 30 acts as an indexing/locating feature and is used to orient the plastic container 10 for labeling without disturbing the aesthetics or negatively affecting the stability of the plastic container 10.

In order to enhance the visual perception of the plastic container 10 as square shaped, the dimension of the shoulder width 36 is substantially equal to the dimension of the base width 40. Similarly, in order to enhance the visual perception of the plastic container 10 as square shaped, the dimension of the diagonal distance 39 between opposite rounded corners 38 of the shoulder region 14 is greater than the base width 40.

Figure 2:
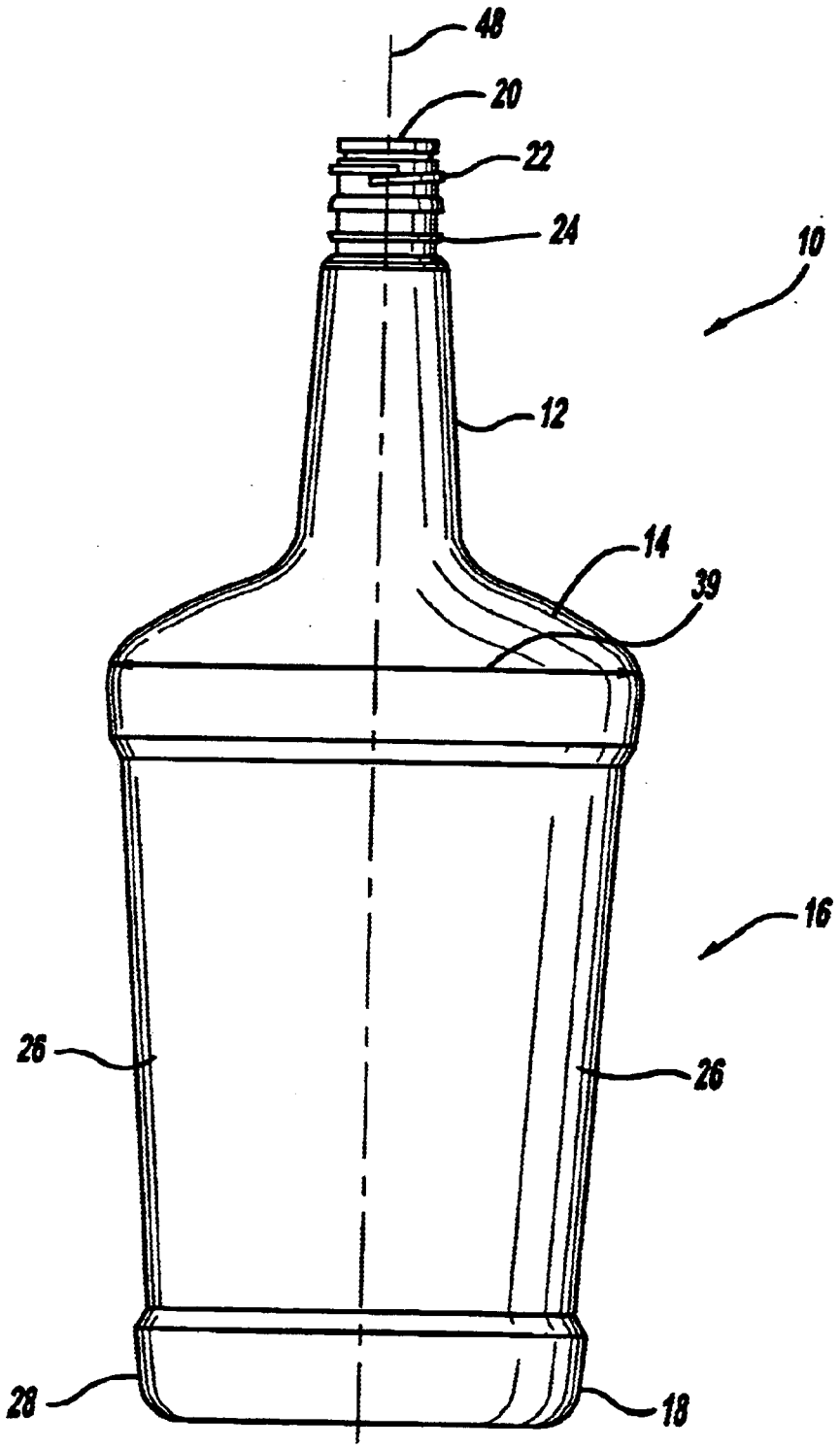
FIG. 2 is an elevational view taken from a front left corner of the plastic container in FIG. 1.
Figure 3:
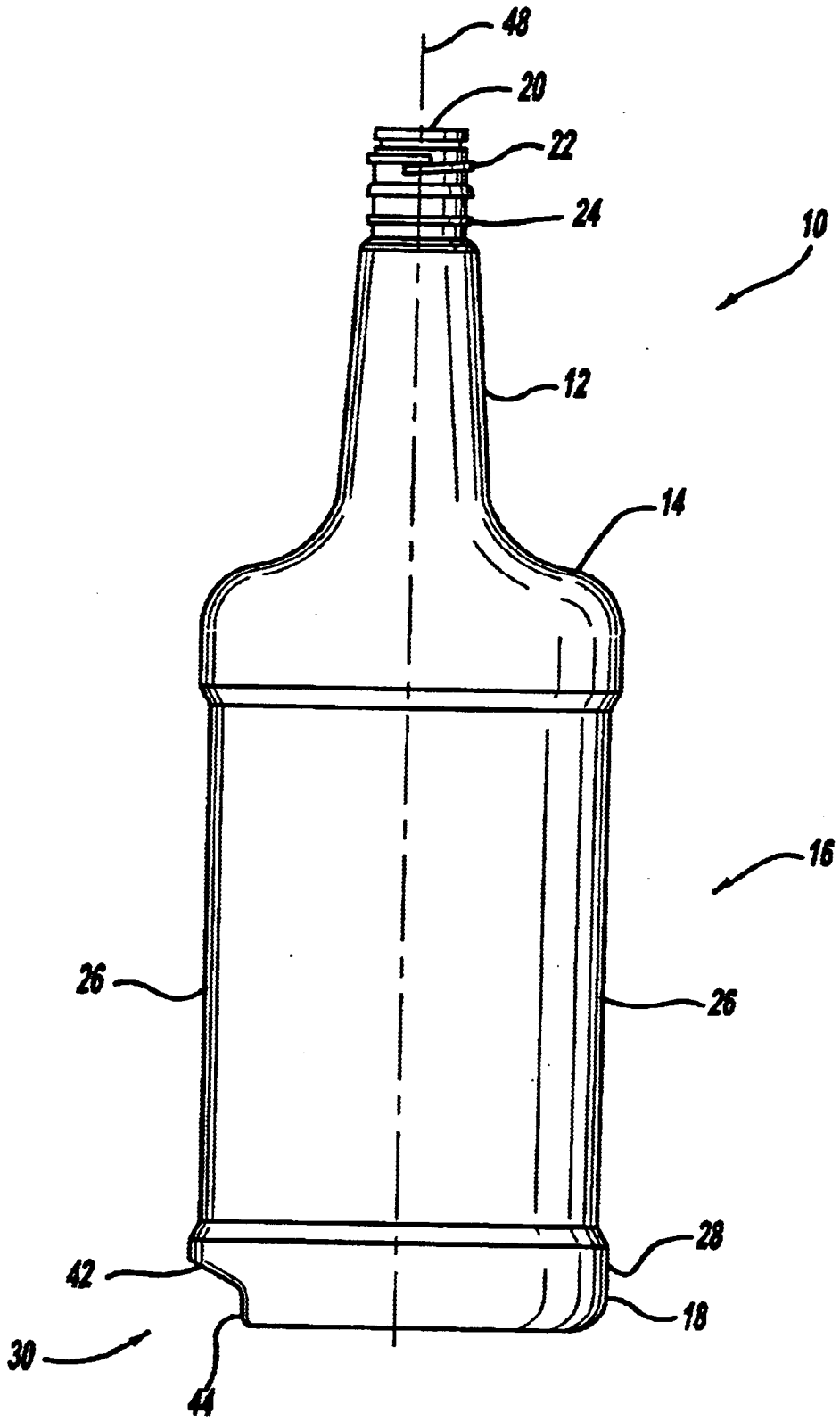
FIG. 3 is a left elevational view of the plastic container in FIG. 1.
Figure 4:
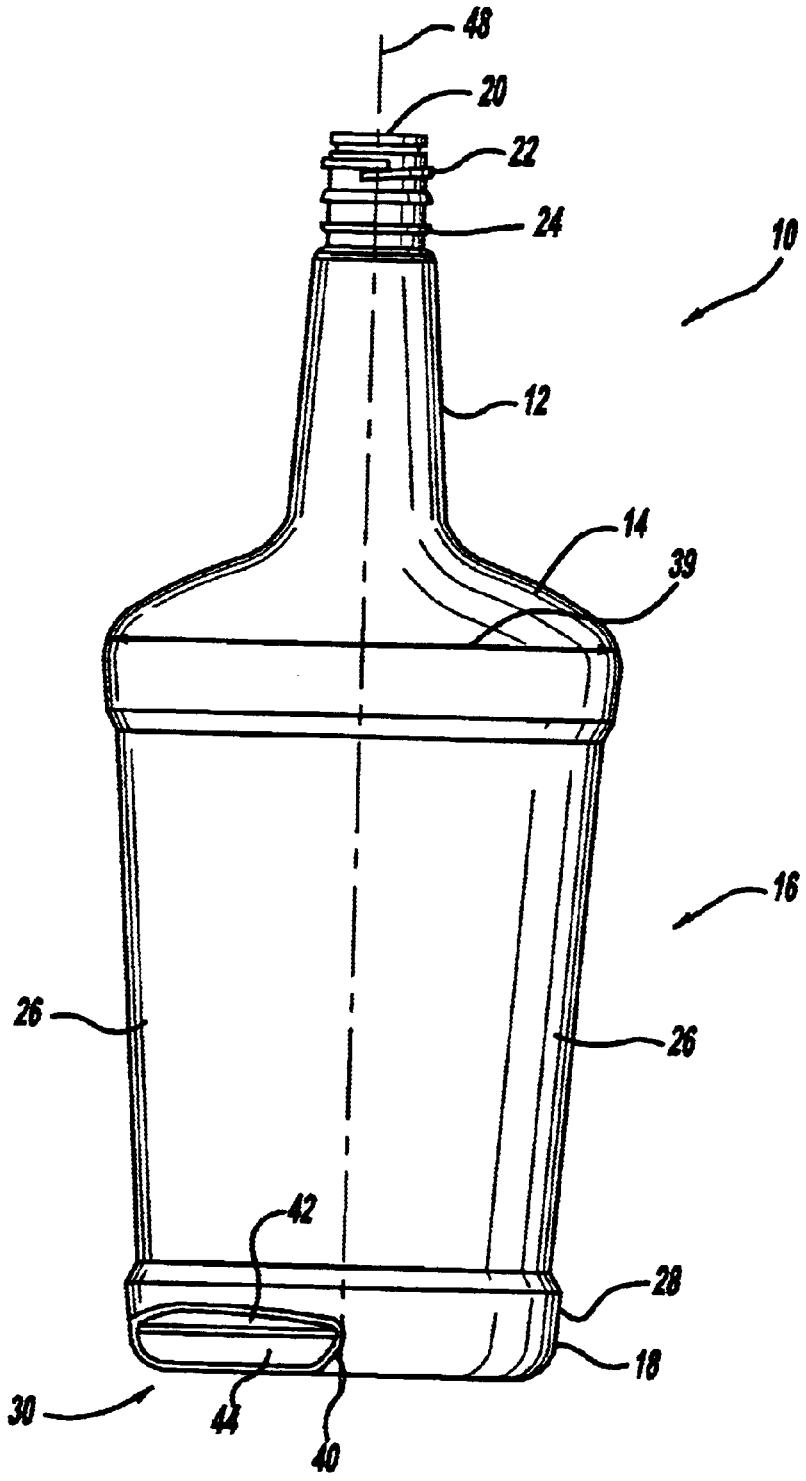
FIG. 4 is an elevational view taken from a rear left corner of the plastic container in FIGS. 1 and 3.
Figure 5:
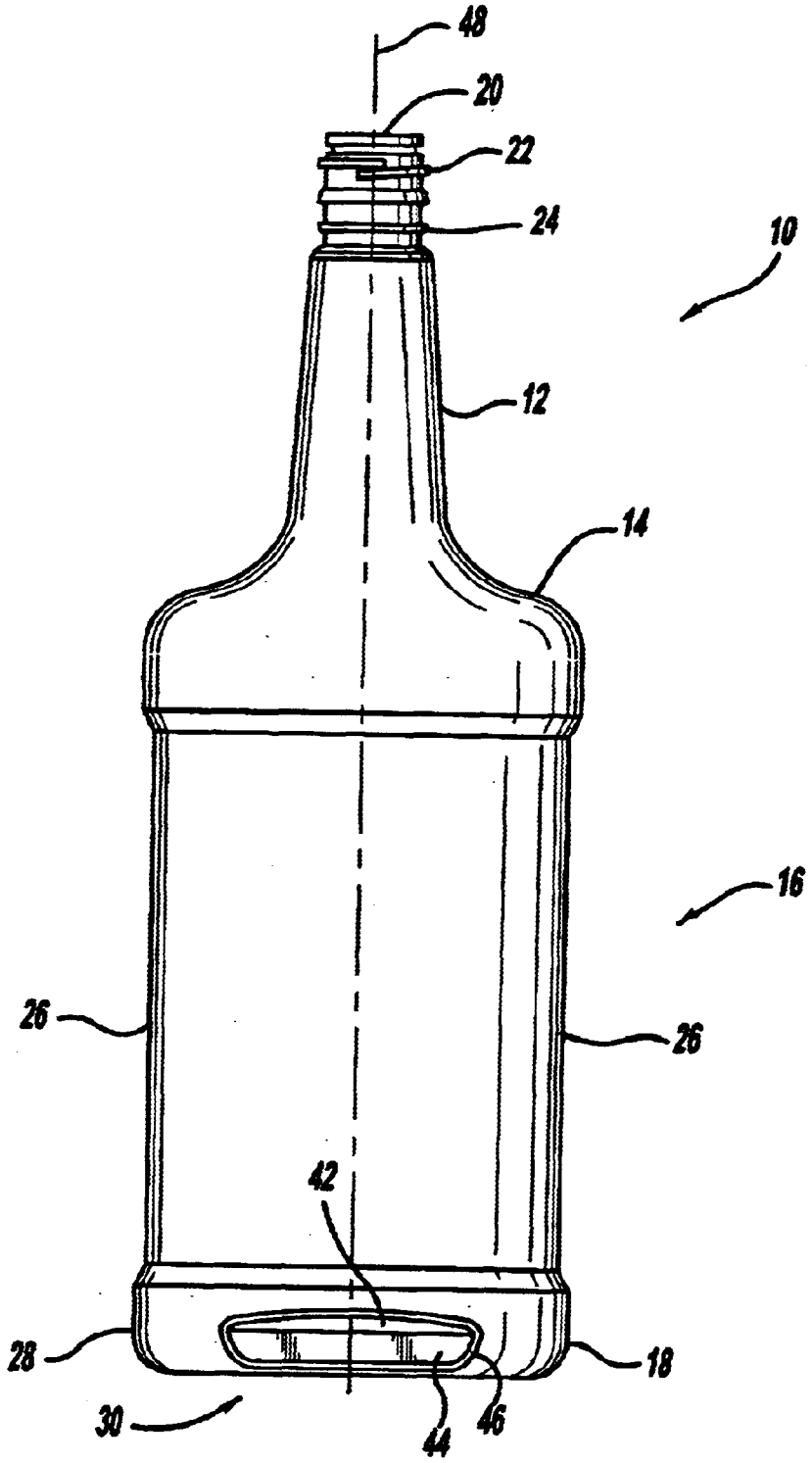
FIG. 5 is a rear elevational view of the plastic container in FIG. 1.
Figure 9:
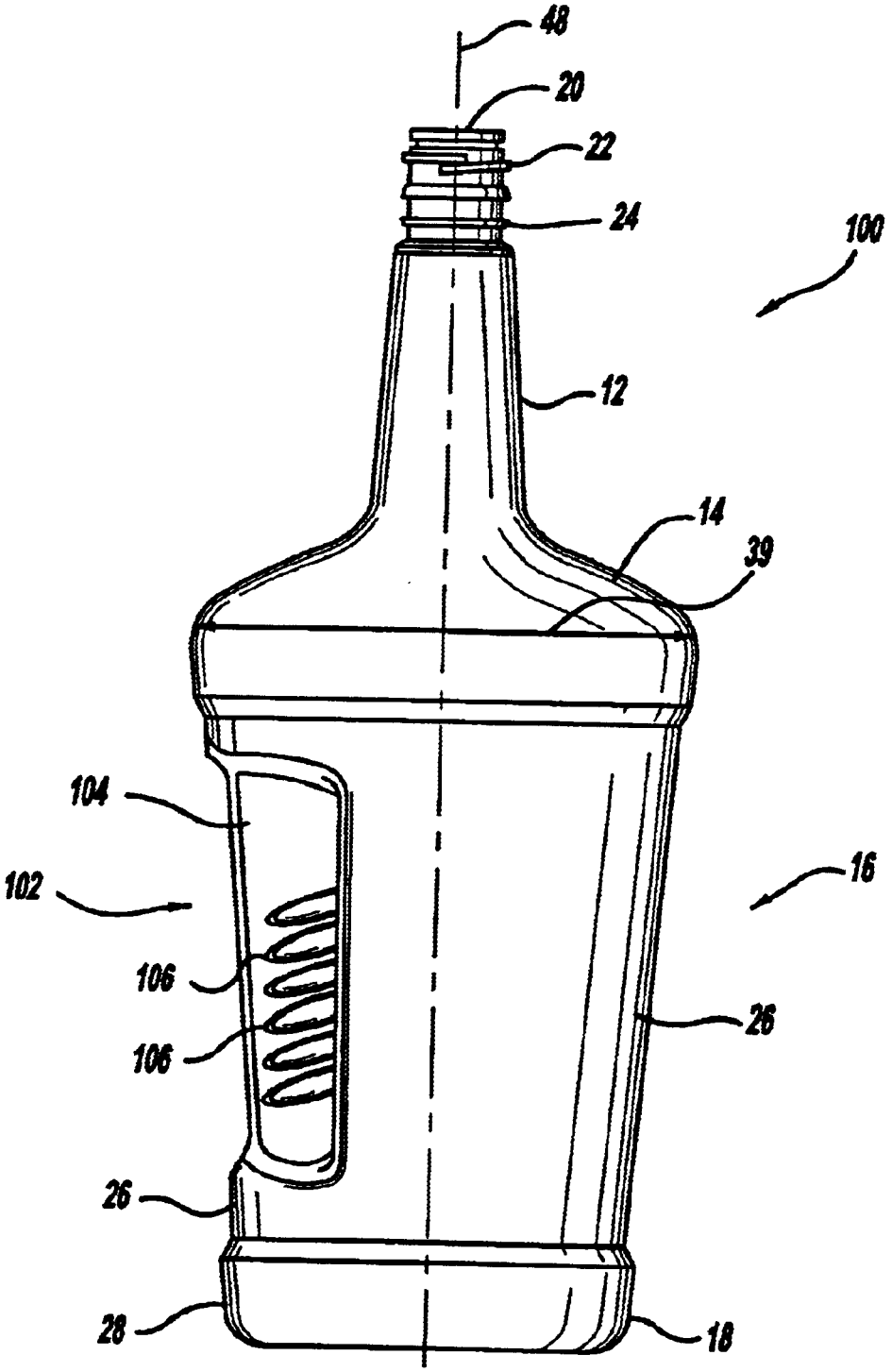
FIG. 9 is an elevational view taken from a front left corner of the plastic container in FIG. 8.

Additionally, in order to enhance the visual perception of the plastic container 10 as square shaped, the sidewalls 26, which are generally arcuate in shape, having a relatively large radius, gradually (at an angle of 13° or less from a center line 48 as shown in FIGS. 2, 4 and 9) taper downward from the shoulder region 14 toward the base 18. In this regard, the center line 48 on the sidewalls 26, extending from the midpoint 34 of the shoulder region 14 toward the base 18, is substantially a straight vertical line.

As a result, the sidewalls 26 of the plastic container 10, when viewed from the front as in a retail display, appear to be relatively flat, similar to the sides 32 of the shoulder region 14. This effect is created by the customer's eye focusing on the straight vertical center line 48 on the sidewalls 26 in profile rather than focusing on the increasing curvature of the sidewalls 26 as they descend and gradually taper downward from the shoulder region 14 to the base 18.

The above described visual effect may be further enhanced by the labeling of the bottle. The label can be designed to direct a customer's visual attention to the square shaped shoulder region 14. Also, a majority of the label may be located on the substantially flat upper portion of the sidewalls 26. The label may also use subtle variations of shape or line width to alter the perspective of the customer and give a more square like appearance as is well known in the visual arts.

As described above, the sides 32 of the shoulder region 14 and the sidewalls 26 of the plastic container 10 are not actually flat, but rather are generally arcuate in shape. Accordingly, the radii of the generally arcuate shaped sides 32 and the sidewalls 26 decreases progressively from the shoulder region 14 to the base 18. As a result of the above construction, the structural resistance of the sidewalls 26 to sinking in is greatly improved over traditional square shaped plastic containers having flat sides. The enhanced rigidity of the rounded corners 38 of the shoulder region 14 and the portions of the sidewalls 26 proximate thereto, lends support to the flatter upper portion of the sidwalls 26. The lower portions of the sidewalls 26 have the typical structural resistance to sinking in normally found in any circular shaped plastic container.

Accordingly, the shoulder region 14 of the plastic container 10 having a substantially square shaped cross section preserves the brand identification benefits associated with a square shaped container while the substantially circular cross section attributes of the base 18 increases the structural stability and ease which the plastic container 10 is handled during transfer, filling and labeling operations thus allowing the plastic container 10 to run on a faster production line.

Figure 8:
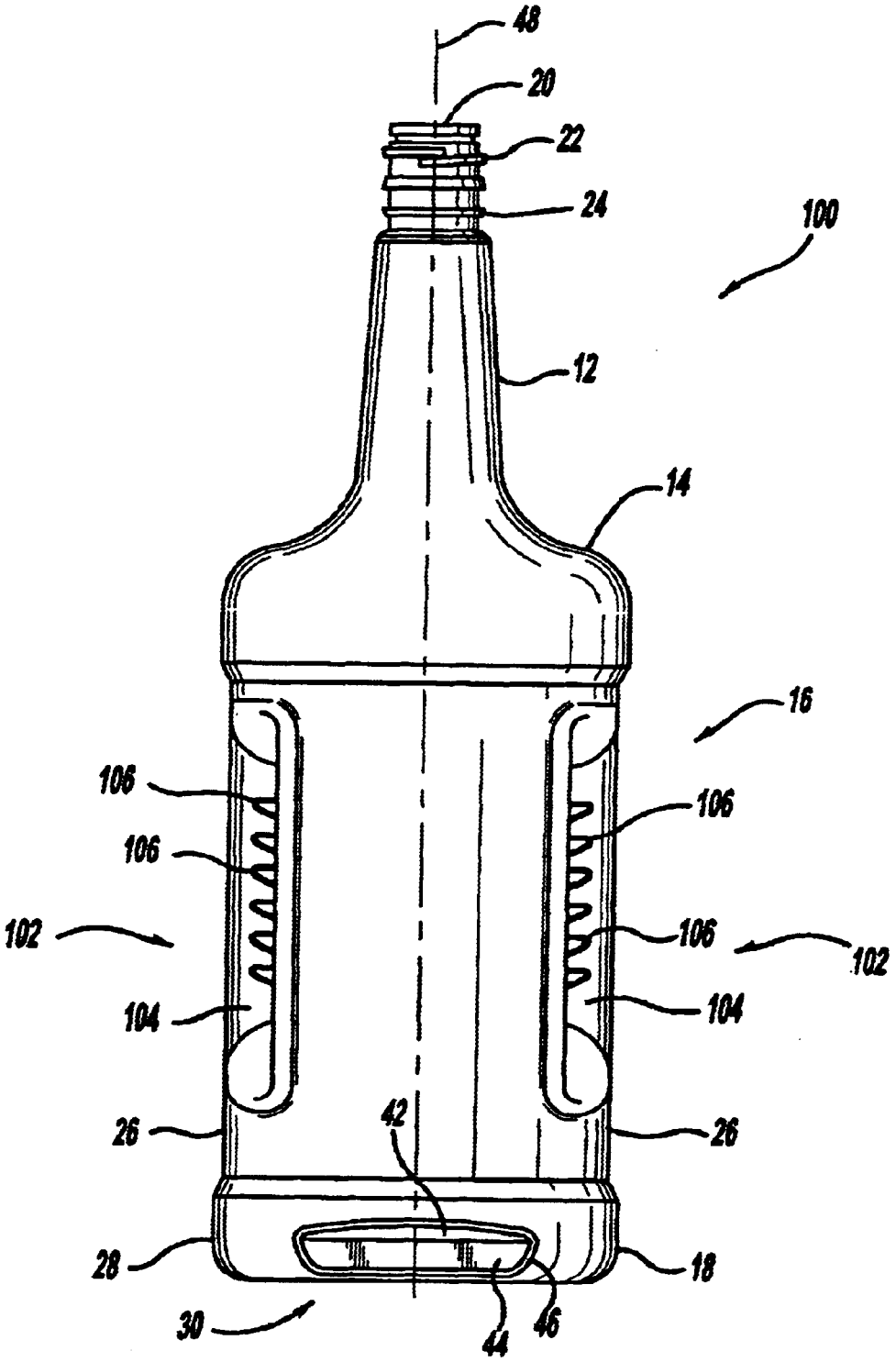
FIG. 8 is a rear elevational view of a second embodiment of a plastic container in accordance with the present invention.

FIGS. 8 and 9 illustrate a second general embodiment 100 of a plastic container according to the invention. As noted previously, the second embodiment 100 of the invention includes pinch grips as are well known in the art, but still exhibits the desired brand identification benefits associated with a square shaped container and the handling, structural attributes associated with a circular shaped container. Like reference numerals will be used to describe like components between the two embodiments. As with the previous embodiment 10, the plastic container 100 includes, but is not limited to, the elongated neck 12, the shoulder region 14, the body portion 16 and the base 18. The plastic container 100 differs primarily from the previous embodiment 10 in that it includes pinch grips.

The plastic container 100 includes an opposed pair of indentations 102 formed in two opposing sidewalls 26, which enables the plastic container 100 to be grasped between a user's thumb and fingers of one hand. Each of the indentations 102 comprise a large generally rectangular shaped surface 104. Each of the surfaces 104 include a plurality of generally horizontally spaced anti-slip finger grips 106, each of which also forms a stiffener rib in the surface 104. As a result, each of the finger grips 106 is convex in a direction outward of the plastic container 100.

Accordingly, a user of the plastic container 100, desiring to lift the container, either for transport purposes or for tipping purposes to discharge the contents, will position his/her hands on the sidewalls 26 so that the thumb is engaged with one of the indentations 102 and the fingers are engaged with the opposite indentation 102. The finger grips 106 facilitate such engagement and ensure against inadvertent slipping.

While the above description constitutes the preferred embodiments of the present invention, it will be appreciated that the invention is susceptible to modification, variation and change without departing from the proper scope and fair meaning of the accompanying claims.

We claim:

1. A plastic container comprising:

a neck having a mouth defining an opening into said container, a shoulder region extending from said neck, a body portion extending from said shoulder region to a base, said base closing off an end of said container; said neck, said shoulder region, said body portion and said base cooperating to define a receptacle chamber within said container into which product can be filled; said shoulder region having a substantially square cross section and including four sides of substantially equal length and four corners integrally formed with and between said sides, each of said four sides of said shoulder region includes a midpoint, wherein a shoulder width is defined by a dimension between said midpoints of opposing sides, wherein a diagonal dimension between opposing corners of said shoulder region is greater than a base diameter; said base having a substantially circular cross section; wherein a vertical sidewall profile between said midpoint of said shoulder region and said base being a substantially straight line; said body portion including gradually tapered sidewalls extending from said corners of said shoulder region to said base; wherein a shoulder width is substantially equal to said base diameter.

2. The container of claim 1 wherein said neck is elongated.

3. The container of claim 1 wherein said base includes an intravenous slot formed therein.

4. The container of claim 1 further comprising indentations suitable for gripping formed in two opposing sidewalls.

5. The container of claim 1 wherein said sidewalls include an upper portion having a radius of curvature and a lower portion having a radius of curvature, said radius of curvature of said upper portion being greater than said radius of curvature of said lower portion.

6. A plastic container comprising:

a neck having a mouth defining an opening into said container, a shoulder region extending from said neck, a body portion extending from said shoulder region to a base, said base closing off an end of said container; said neck, said shoulder region, said body portion and said base cooperating to define a receptacle chamber within said container into which product can be filled; said shoulder region having a substantially square cross section and a width, and including four sides of substantially equal length and four corners integrally formed with and between said sides, each of said four sides of said shoulder region includes a midpoint, and a vertical sidewall profile between said midpoint and said base being a substantially straight line, wherein a diagonal dimension between opposing corners of said shoulder region is greater than a diameter of said base; said base having a substantially circular cross section; said body portion including gradually tapered sidewalls extending from said corners of said shoulder region to said base; wherein said width of said shoulder region is substantially equal to said diameter of said base.

7. The container of claim 6 wherein said neck is elongated.

8. The container of claim 6 wherein said base includes an intravenous notch formed thereon.

9. The container of claim 6 further comprising indentations suitable for gripping formed in two opposing sidewalls.

10. The container of claim 6 wherein said sidewalls include an upper portion having a radius of curvature and a lower portion having a radius of curvature, said radius of curvature of said upper portion being greater than said radius of curvature of said lower portion.

* * * * *